US009052171B2

(12) United States Patent
Rastegar

(10) Patent No.: US 9,052,171 B2
(45) Date of Patent: Jun. 9, 2015

(54) METHODS AND DEVICES FOR PROVIDING GUIDANCE AND CONTROL OF LOW AND HIGH-SPIN ROUNDS

(71) Applicant: Jahangir S Rastegar, Stony Brook, NY (US)

(72) Inventor: Jahangir S Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 0 days.

(21) Appl. No.: 14/176,074

(22) Filed: Feb. 8, 2014

(65) Prior Publication Data

US 2014/0224922 A1 Aug. 14, 2014

Related U.S. Application Data

(60) Provisional application No. 61/762,935, filed on Feb. 10, 2013.

(51) Int. Cl.

| | |
|---|---|
| ***F42B 10/60*** | (2006.01) |
| ***F42B 10/62*** | (2006.01) |
| ***F42B 10/64*** | (2006.01) |
| ***F42B 10/66*** | (2006.01) |
| ***F42B 15/01*** | (2006.01) |
| *F42B 10/00* | (2006.01) |
| *F42B 15/00* | (2006.01) |

(52) U.S. Cl.

CPC ..... *F42B 15/01* (2013.01); *F42B 10/64* (2013.01); *F42B 10/661* (2013.01)

(58) Field of Classification Search

CPC ..... F42B 10/60; F42B 10/62; F42B 10/64; F42B 10/66; F42B 10/661; F42B 15/01

USPC ..... 102/382, 383, 384, 473, 480, 501, 200, 102/206, 217, 475, 476, 517, 520; 244/3.1, 244/3.15, 3.21–3.3

See application file for complete search history.

(56) References Cited

U.S. PATENT DOCUMENTS

| | | | | | |
|---|---|---|---|---|---|
| 34,685 | A * | 3/1862 | Hathaway | 102/480 |
| 1,737,833 | A * | 12/1929 | D'Orsaneo | 102/480 |
| 5,163,637 | A * | 11/1992 | Hansen | 244/3.21 |
| 5,191,169 | A * | 3/1993 | Hu | 102/480 |
| 5,915,694 | A * | 6/1999 | Brum | 102/501 |
| 5,988,071 | A * | 11/1999 | Taylor | 102/473 |
| 6,786,157 | B1 * | 9/2004 | Powell | 102/476 |
| 6,860,448 | B2 * | 3/2005 | Rastegar | 244/3.27 |
| 7,194,943 | B2 * | 3/2007 | O'Dwyer | 102/217 |
| 7,800,031 | B2 * | 9/2010 | Rastegar et al. | 244/3.22 |
| 8,319,164 | B2 | 11/2012 | Martinez | |
| 8,424,233 | B2 * | 4/2013 | Cronin et al. | 102/520 |

* cited by examiner

*Primary Examiner* — Bernarr Gregory

(57) ABSTRACT

A method for deploying a control surface from an exterior surface of a spinning projectile during flight is provided. The method including: moving the control surface in an interior of the projectile such that a portion of the movement retracts the control surface into the interior and a portion of the movement extends the control surface from the exterior surface of the projectile; determining a roll angle of the projectile; and synchronizing the movement of the control surface with the roll angle of the projectile.

20 Claims, 7 Drawing Sheets

METHODS AND DEVICES FOR PROVIDING GUIDANCE AND CONTROL OF LOW AND HIGH-SPIN ROUNDS

CROSS-REFERENCE TO RELATED APPLICATIONS

This application claims benefit to U.S. Provisional Application No. 61/762,935 filed on Feb. 10, 2013, the entire contents of which is incorporated herein by reference.

BACKGROUND OF THE INVENTION

1. Field of the Invention

The present invention relates generally to guidance and control systems, and more particularly, to methods and devices for providing guidance and control of low and high-spin rounds.

2. Prior Art

Since the introduction of 155 mm guided artillery projectiles in the 1980's, numerous methods and devices have been developed or are under development for guidance and control of subsonic and supersonic rounds. These include different technologies and related components such as actuation devices, position and angular orientation sensors, and guidance and control hardware and algorithms. The majority of these devices have been developed based on missile and aircraft technologies, which are in many cases difficult or impractical to implement on gun-fired projectiles and mortars. This is particularly true in the case of actuation devices, where electric motors of various types, including various electric motor designs with or without gearing, voice coil motors or solenoid type actuation devices used to actuate control surfaces have dominated the guidance and control of most guided weaponry. Thrusters of various types have also been successfully employed. However, currently available thrusters are suitable only for low or no-spin rounds due to their limitations in terms of relatively long pulse widths and unpredictable actuation delays. Other currently available actuation technologies developed for munitions applications are suitable for non-spinning rounds or for rounds with very low spinning rates.

Current guidance and control technologies and those under development are not effective for flight trajectory correction of high-spin guided munitions. Such spin stabilized rounds may have spinning rates of 200 Hz or higher, which pose numerous challenging sensing, actuation and control force generation and control algorithm and processing issues that need to be effectively addressed using innovative approaches. In addition, unlike missiles, all gun-fired spinning rounds are provided with initial kinetic energy through the pressurized gasses inside the barrel and are provided with flight stability through spinning and/or fins. As a result, they do not require in-flight control action for stability and if not provided with trajectory altering control actions, such as those provided with control surfaces or thrusters, they would simply follow a ballistic trajectory. This is still true if other means such as electromagnetic forces are used to accelerate the projectile during the launch or if the projectile is equipped with range extending rockets. As a result, unlike missiles, control inputs for guidance and control is required only later during the flight and in many cases as the projectile approaches the target.

In recent years, alternative methods of actuation for flight trajectory correction have been explored, some using smart (active) materials such as piezoelectric ceramics, active polymers, electrostrictive materials, magnetostrictive materials or shape memory alloys, and others using various devices developed based on micro-electro-mechanical (MEMS) and fluidics technologies. In general, the available smart (active) materials such as piezoelectric ceramics, electrostrictive materials and magnetostrictive materials (including various inch-worm designs and ultrasound type motors) need to increase their strain capability by at least an order of magnitude to become potential candidates for actuator applications for guidance and control, particularly for gun-fired munitions and mortars. In addition, even if the strain rate problems of currently available active materials are solved, their application to gun-fired projectiles and mortars will be very limited due to their very high electrical energy requirements and the volume of the required electrical and electronics gear. Shape memory alloys have good strain characteristics but their dynamic response characteristics (bandwidth) and constitutive behaviour need significant improvement before becoming a viable candidate for actuation devices in general and for munitions in particular, even those with very low spin rates.

All currently available actuation devices based on electrical motors of various types, including electrical motors, voice coil motors and solenoids, with or without different gearing or other mechanical mechanisms that are used to amplify motion or force (torque), and the aforementioned recently developed novel methods and devices (based on active materials, such as piezoelectric elements, including various inch-worm type and ultrasound type motors), or those known to be under development for guidance and control of airborne vehicles such as missiles, suffer from the basic shortcoming of not being capable of providing the dynamic response levels that are required for guidance and control of high-spin rounds with spin rates of up to 200 Hz or higher. This fact is readily illustrated by noting that, for example, a round spinning at 200 Hz would undergo 72 degrees of rotation in only 1 msec. This means that if the pulse duration is even 1 msec and its unpredictable initiation time (pulse starting time) is off by 1 msec, then the direction of the effective impulse acting on the round could be off by over 90 degrees, i.e., when a command is given to divert the round to the right, the round may instead be diverted up or down. Such a level of uncertainty in the "plant" (round) trajectory correction response makes even the smartest feedback control system totally ineffective.

The most important sensory input for a guidance and control system of a high-spin round is that of the roll angle measuring sensor. Roll angle measurement in munitions has been a challenge to guided munitions designers in general and for high-spin rounds in particular. The currently available laser gyros are impractical for use in munitions due to size, cost and survivability. Magnetometers are also impractical since they can only measure angle in two independent directions, which may not be aligned for roll angle measurement at all times during the flight. Their angle measurement is also not precise and requires a local map and is susceptible to environment in the field. Inertial based gyros may be used, but require initiation at regular time intervals to overcome initial settling and drift issues.

In summary, the currently available guidance and control systems and their components suffer from one or more of the following major shortcomings that make them impractical for application to high-spin guided munitions:

1. Limited Dynamic Response: The munitions with high spin rates demand control actuation of any type to provide very short duration (sub-millisecond) "pulses" in order for the control action to be applied over only a limited range of munitions roll angle. For a round spinning at 200 Hz, if the control actuation is to be applied over a 10 degrees range of roll angle, then the control actuation must be applied for only around 0.14 milliseconds, or at an equivalent frequency of around 7,200 Hz. This would obviously eliminate any of the aforementioned currently available actuation devices for such high-spin round guidance and control applications.

2. Actuation Pulse Timing and Duration: In addition to the above dynamic response limitations, the fastest thruster or impulse type guidance and control actuation devices that are currently available suffer from two basic shortcomings: (1) actuation pulse timing precision; and (2) pulse width precision. The first shortcoming is mainly due to unpredictable delays in the initiation devices, while the second shortcoming is mainly due to the relatively long pulse durations in commonly used thrusters or the like in current technologies.

3. Roll Angle Measurement: An effective guidance and control technology for high-spin rounds requires sensors for onboard measurement of the projectile roll angle. The roll angle sensor has to provide the require precision and should not be subject to drift or other similar effects that over time during the flight causes error to accumulate and render roll angle measurement unreliable. It is also appreciated that one may use roll angle sensors that are subject to drift and exhibit relatively long settling times, but in such cases, appropriate means have to be provided for initialization of the sensor at regular and often time intervals.

4. High Power Requirement: All currently used actuation mechanism working with electrical motors and/or solenoids of different types as well as actuators based on active materials, such as piezoelectric materials and electrostrictive materials and magnetostrictive materials (including various inch-worm designs and ultrasound type motors) and shape memory based actuator designs, are only applicable to munitions with low spin rates. But even in such applications, they demand high electrical power for their operation.

5. Occupy Large Munitions Volume: One solution that has been employed or has been considered for high-spin guidance and control has been de-spinning the entire round or a section of the round where the control surface or the like are positioned. As a result, the aforementioned issues with high-spin rates are resolved. Such solutions are, however, impractical for medium caliber munitions due to the lack space to provide the means to de-spin the round. Such solutions are practical for larger caliber rounds, but even for these cases they are highly undesirable for the following reasons. Firstly, the actuation devices and mechanisms required for de-spinning occupy a significant portion of the round volume. The available volume for payload is also further reduced since fins (or larger fins) or other stabilizing means must also be provided to ensure stable flight. As a result, the weapon lethality is significantly reduced. In addition, a significant amount of power has to be provided for de-spinning of the round.

6. High cost of the existing technologies, which results in very high-cost rounds, thereby making them impractical for large-scale fielding.

7. Relative technical complexity for the implementation of the current guidance and control technologies for high-spin rounds such as for de-spinning of the entire round or its guidance and control section, which results in increased munitions cost.

SUMMARY OF THE INVENTION

A need therefore exists for the development of innovative, low-cost guidance and control technologies for high-spin rounds that address the aforementioned limitations of currently available technologies in a manner that leaves sufficient volume inside munitions for other components such as communications electronics and fusing, as well as the explosive payload to satisfy the lethality requirements of the munitions.

Such guidance and control technologies must consider the relatively short flight duration for most gun-fired projectiles and mortar rounds, which leaves a very short period of time within which trajectory correction/modification has to be executed. This means that such actuation devices must capable of providing very short duration "pulsed" actuation (of the order of 100-200 microseconds for spin rates of around 200 Hz) at precisely prescribed and repeatable roll angle ranges (preferably around 10 degrees), which translates to relatively large "impulses" of the order of 10 N-sec to 140 N-sec for 100-200 microseconds for spin rates of around 200 Hz and up to 2 milliseconds for low spin rates of 10-20 Hz. To achieve an effective guidance and control system for high-spin rounds, the system roll sensor must also be very accurate (precision of the order of 1-2 degrees or better) to be capable of providing initiating and/or synchronization timing for the actuation pulses.

The novel pulsed actuation devices may be divided into two relatively distinct categories. Firstly, pulsed actuation device devices for munitions with relatively long flight time and in which the guidance and control action is required over relatively longer time periods. These include munitions in which trajectory correction/modification maneuvers are performed during a considerable amount of flight time as well as within relatively short distances from the target, i.e., for terminal guidance. In many such applications, a more or less continuous control actuation may be required. Secondly, pulsed actuation devices for munitions in which the guidance and control action is required only within a relatively short distance to the target, i.e., only for terminal guidance purposes.

The guidance and control technologies and their components must also consider problems related to hardening of their various components for survivability at high firing setback shock loading, high spin rates and the harsh firing environment. They must also be scalable to medium caliber rounds. Reliability is also of much concern since the rounds need to have a shelf life of up to 20 years and could generally be stored at temperatures in the range of −65 to 165 degrees F.

The guidance and control technology devices are constructed by the integration of two major components; actuation devices that can provide very narrow pulsed control actuation at precise roll angles; and precision roll angle sensors that can provide direct roll angle measurement onboard the munitions. This disclosure includes two classes of novel pulsed actuation devices that can provide very short duration actuation pulses with precision timing necessary for generating effective control action in high spin guided munitions. A polarized RF roll angle sensor which can resolve "up and down" orientation is for precision and direct onboard measurement of the projectile roll angle. The basic guidance and control algorithm that can be used for trajectory correction and/or modification is also provided. The onboard position determination options for fully autonomous and for command guidance are also provided The two detonation-based pulsed impulse generation actuation devices are suitable mostly for short duration actuation such as for terminal guidance applications due to the limitation on the number of such pulses that can be practically provided in a round. These actuation devices are capable of being embedded into the structure of the projectile as load bearing structural components, thereby occupying minimal projectile volume. The novel electrical initiation devices employed in these actuation devices are very low power and designed to provide very fast initiation with high precision timing. The second class of actuation impulse generating devices also provide very short actuation pulses with precision timing and can provide quasi-continuous actuation during the entire flight.

The pulsed actuation devices and roll angle sensors for the present novel guidance and control technologies are partly based on U.S. Pat. Nos. 8,286,554; 8,259,292; 8,258,999; 8,164,745; and 8,076,621, the entire contents of each of which are incorporated herein by reference.

The novel guidance and control technology devices, including their novel pulsed actuation and roll angle sensors, their basic characteristics, modes of operation, and envisioned method of their manufacture and integration into the structure of projectiles are described in detail below. Such guidance and control technology provides very effective, low power, very low cost, high dynamic response control systems for high spin guided munitions that occupy relatively small useful projectile volume. It is also shown that the novel guidance and control technology and their components can be applied to any high as well as low spin large and medium caliber guided munitions. They are also applicable to direct as well as indirect fire guided munitions. In addition, since their main components are similar to those currently used in fielded munitions, they should be able to be designed to withstand very high-G firing setback accelerations of well over 50 KG, provide shelf life of over 20 years and properly operate in the military range of temperature of −65 to 165 degrees F.

Next, the design and operation of the pulsed actuation devices for guidance and control system of high-spin guided munitions are described in detail. Two classes of these pulsed actuation devices are based on detonation of charges and can be used for terminal guidance of guided munitions. The third class of devices operate by electrical motors that run essentially at constant speed, thereby minimizing the electrical energy that they require for their operation and are intended to provide a nearly continuous pulsed actuation to high-spin guided munitions during the flight.

Novel technologies for guidance and control systems for flight trajectory correction of guided spinning munitions in general and high-spin rounds in particular. The technologies are intended for integration in munitions with low (around 20 Hz) as well as high (200 Hz or higher) spin rates and address pulsed actuation, sensory input requirements, as well as control algorithms required to address guidance and control issues that are specific to high-spin rounds. The guidance and control technologies and related devices require low power for their operation; are readily hardened to survive firing setback shocks of 50 KG and over; withstand harsh firing environment; and are made of components that have shown have shelf life of over 20 years. They are also low cost and readily scaled to almost any caliber munitions, including medium caliber munitions.

The technologies include two classes of novel short-duration pulsed impulse technologies that are constructed using an ultra-high speed initiation technology that also minimizes the unpredictable actuation delay and one class of novel "pulsed" actuation devices that are driven by electrical motors that can be driven by currently available electrical motors that are hardened for gun firing; polarized RF sensors for onboard direct and precision measurement of roll angle to maximize the effectiveness of the pulsed actuation system; and a control algorithm that would account for the issues that are encountered in high-spin rounds in achieving effective control action, particularly with a limited allocated space for the actuation as well as the power source and control electronics. Not included are devices that require de-spinning of the entire or a section of the round since such have been shown to occupy a significant volume of the round, thereby significantly reduce lethality; require a very large amount of power to operate; and are very costly to implement.

The novel guidance and control technology devices for guided spinning munitions provide the following novel features and basic characteristics:

1. Provide novel integrated guidance and control technology devices that would address all major challenges that are currently facing guided munitions designers for high-spin rounds, including provision of novel and very short duration pulsed actuation devices with very high timing precision and repeatability (of the order of 100-200 microsecond duration); and sensors for direct and precision measurement of roll angle for closing feedback guidance and control loop. It is noted that for guidance and control of munitions spinning at rates of around 200 Hz, the actuation pulse duration needs to be around 100-200 microsecond with similar or smaller pulse timing precision and repeatability.

2. Three novel pulse-type control actuation devices are disclosed, two of which are based on detonation of small amounts of charges to achieve short duration pulses with highly predictable timing and duration, and one revolutionary method of providing control surface or drag type of pulsed control actuation with extremely short deployment to provide very short duration "pulsed" control actuation with very high precision timing (as short a duration as 100-200 micro-seconds). The pulsed actuation devices can provide impulses equivalent (several pulses in one second) of 10 N-sec to 140 N-sec for up to 2 milliseconds.

3. The two detonation-based actuation devices provide high impulse levels with very short durations and with minimal unpredictable impulse initiation and duration times to enable guidance control action for flight trajectory correction and/or modification of high-spin munitions.

4. The two detonation-based actuation devices provide a novel manner of integrating a very fast and low power electrical initiation technology with a multi-shot detonation based impulse unit to achieve very fast acting and short duration impulses that can be timed with appropriate precision for control action of the novel guidance and control technology.

5. The third novel pulse-type control actuation device is based on providing a novel synchronized control surface or drag element for high-spin projectiles with spin rates of up to 200 Hz or even higher. This pulsed actuation device may be of lift and/or drag inducing type to generate aerodynamic forces/torques. The device could provide the means of applying quasi-continuous control force/torque to high-spin rounds without the requirement of very high-bandwidth actuation devices. The pulsed actuation device is driven by an electrical motor that rotates at constant speed, and would thereby does not require high bandwidth requires relatively low power to operate.

6. Provide onboard sensors for direct and precision measurement of the roll angle to enable munitions guidance and control system to precisely time the impulse control action for trajectory correction/modification. For indirect fire applications where pitch and yaw angles may also be required for guidance and control purposes, the angular orientation sensors can be used for their direct measurements. The sensors can also be used for onboard position measurement.

7. Provide very low power pulsed actuation solution for guidance and control of very high spin munitions. The power requirement for the actuation devices is shown to be orders of magnitude less than electrical motor-based actuation devices; reducing electrical energy requirement from KJ to J, i.e., less than a fraction of 1% of the electrical energy required by current electric motors and solenoid type devices (which also require de-spinning of the entire or a section of the round—a highly undesirable technology as previously indicated).

8. The pulsed actuation devices can be readily hardened to survive setback shock loading of well over 50 KG. The two detonation-based actuation devices are essentially integrated into the structure of the munitions as load-bearing structures, thereby occupy minimal added volume and can be designed to withstand shock of well over 50 KG. The third device uses a very small electrical motor with a very simple actuation mechanism. Such small actuation motors have in previous guided munitions been shown to be capable of withstanding firing setback shock loadings of 50 KG and over.

9. The novel pulsed actuation devices are very simple in design, and are constructed with very few moving parts, thereby making them highly reliable even following very long storage times of over 20 years.

10. The novel pulsed actuation devices are very simple in design and utilize existing manufacturing processes and components. As a result, the actuation devices should provide the means to develop highly effective but low cost guidance and control systems for high-spin guided gun-fired projectiles.

11. The guidance and control technologies, including the pulsed actuation devices and sensors, are shown to be scalable to medium as well as large caliber munitions.

12. All components of the guidance and control technologies, including the pulsed actuation devices and sensors are the guidance and control electronics have previously been used in munitions and shown to operate in the temperature range of −65 to 165 degrees F.

13. The novel guidance and control technologies actuators can be used in both subsonic and supersonic spinning projectiles.

The guidance and control technologies, including their novel actuation and sensors provide very low power, low cost, and highly effective solution options for the full range of gun-fired high-spin guided projectiles as well as for lower spin gun-fired guided munitions of various caliber, including medium caliber munitions, mortar and small rockets.

BRIEF DESCRIPTION OF THE DRAWINGS

These and other features, aspects, and advantages of the apparatus and methods of the present invention will become better understood with regard to the following description, appended claims, and accompanying drawings where:

FIGS. 4*a* and 4*b* illustrate a variation of the rotary motor driven actuation device of FIGS. 3*a* and 3*b* in which FIG. 4*b* illustrates the control surfaces being radially deployed relative to a centerline of the projectile as compared to the radial position of the control surfaces in FIG. 4*a*.

DETAILED DESCRIPTION OF THE PREFERRED EMBODIMENT

Multi-Stage Slug-Shot Based Impulse Guidance and Control Actuator

Figure 1:
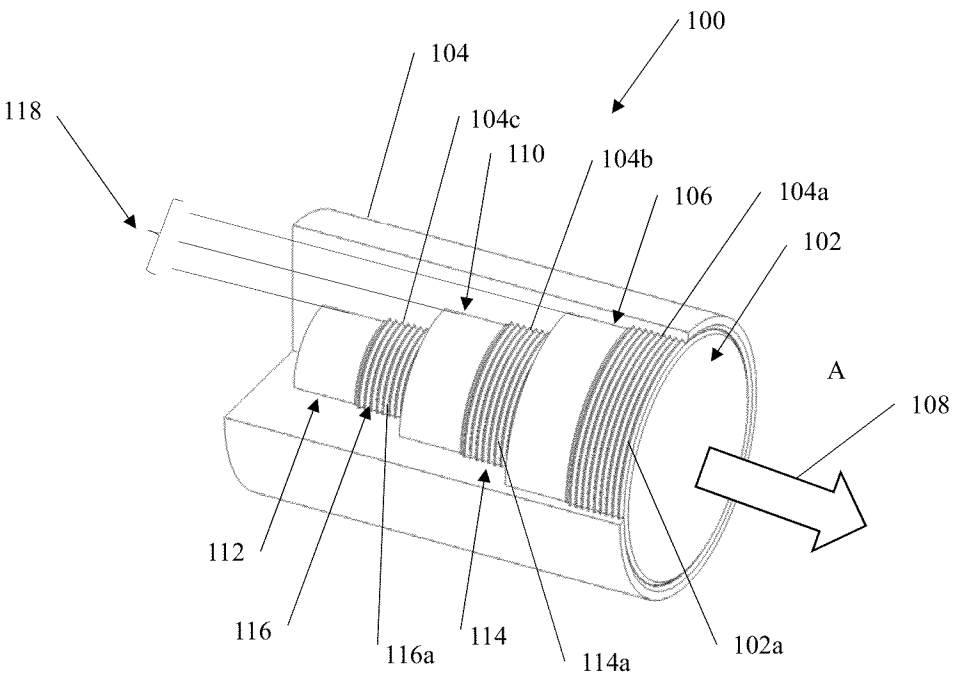
FIG. 1 illustrates a guidance and control actuator for high-spin rounds.

A slug-shot impulse guidance and control actuator for high-spin rounds is shown in FIG. 1 and generally referred to by reference numeral 100. To generate a very short duration shot, the endmost (largest) slug 102 in the actuator housing tube 104 is ejected by igniting the charge 106 behind it (initiators for the charges are shown in FIG. 1 schematically by electrical lines 118 for the sake of clarity). The pressure of the burning propellant from the charge 106 will rise until the threads 104*a*, which engage mating plug threads 102*a*, in the housing tube 104 fail, allowing the slug 102 to be ejected (shot) in the direction of arrow 108 and the high-pressure propulsion charge to flow into the lower-pressure surrounding atmosphere A, thereby generating a very short duration and high amplitude impulse. The remaining charges 110, 112, which are illustrated as being two additional charges but can be any number of charges, are protected against sympathetic initiation by the respective threaded slugs 114, 116 positioned between charges, each slug 114, 116 having threads 114*a*, 116*a*, respectively, engages housing tube threads 104*b*, 104*c*, respectively, as discussed above with regard to slug 102. When the next slug 114 in the alternating stack of slugs and charges is commanded to fire (by initiators 118), the process is similar to that of the first slug 102 and corresponding charge 106. The smaller diameter of the second slug 110 in the stack will ensure that the mangled threads from the ejection of the first slug 102 will not interfere with the ejection of the second slug 106 along its exit path. The third slug 116, and any subsequent slugs, will similarly fire and be ejected.

It is noted that in FIG. 1, the diameter of the second and third slugs 114, 116 are shown to be significantly smaller than the diameter of the front slug 102 for the purpose of demonstration, however, the diameter of each subsequent slug in the stack in the firing direction 108 only needs to be slightly smaller than those in the front of the stack in order to clear threaded portions from previously ejected slugs. In addition, less or more than two slugs may also be employed. It is also noted that a purpose of the housing tube threads 104*a-c* and corresponding slug threads 102*a*, 14*a* and 116*a* are to ensure that pressure and temperature builds up behind each slug following ignition of the charges and thereby increasing the speed of burn and increasing the level of generated impulse. The pulsed actuation device can provide impulses equivalent to (several pulses in one second) of 10 N-sec to 140 N-sec for up to 2 milliseconds. However, any other interference of material between the slugs and housing tube, such as a bayonet type fitting, can be utilized for the same purpose, including the use of one or more separate members, such as a set screw, that is/are not a part of either the slug or housing tube that is/are positioned to interfere with the slug's ejection until pressure and temperature builds up behind each slug following ignition of a corresponding charge.

Solid-state electrical initiation devices with safety circuitry and logic have been tested to show initiation of the secondary pyrotechnic material in 10-15 microseconds. Several of these miniature and very low power initiation devices (shown schematically as 118) can be distributed around the aforementioned detonation charges 106, 110, 112 to achieve very short duration, high impulse level, reliable, and highly predictable (within a maximum of 10-15 microsecond) pulses.

Multi-Shot Impulse Thruster for Guidance and Control Actuator

Figure 2B:
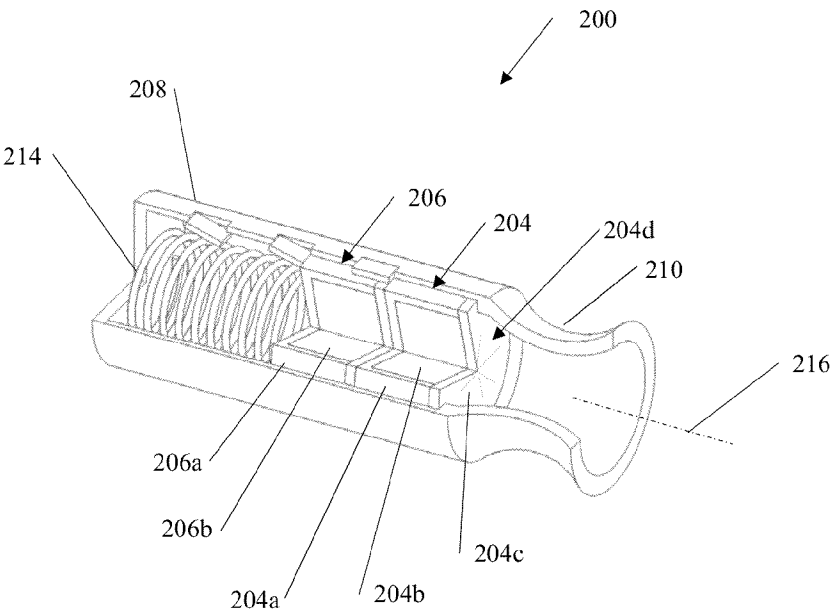
FIG. 2*b* illustrates the thruster of FIG. 2*a* with the front impulse unit being initiated.
Figure 2A:
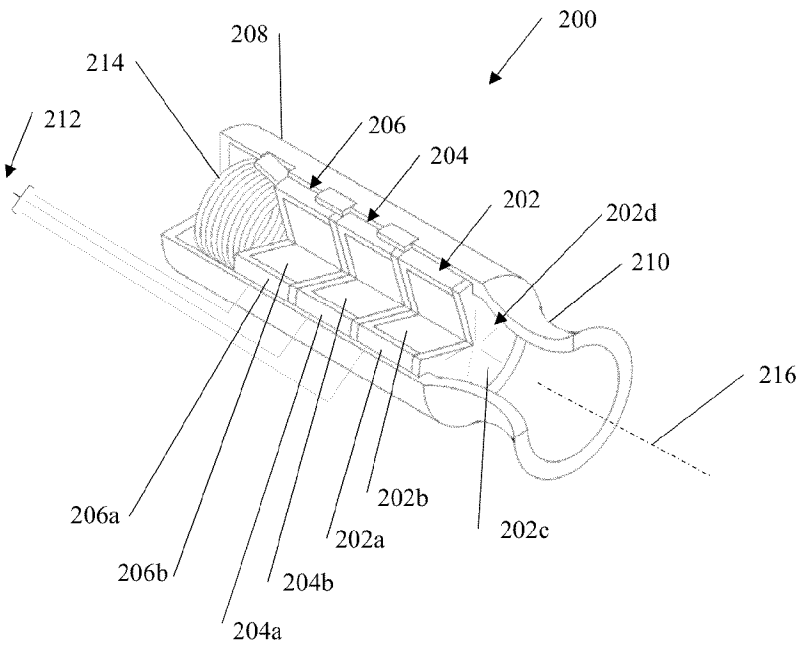
FIG. 2*a* illustrates a multi-shot impulse thruster for guidance and control of high-spin rounds

A multi-shot impulse thruster device for guidance and control of high-spin rounds is shown in FIGS. 2*a* and 2*b*, and generally referred to by reference numeral 200. The thruster 200 significantly increases the generated impulse, decrease its duration and make it more predictable. The multi-stage impulse actuation device is constructed with several "impulse" units 202, 204, 206 (in this case three such units) movably disposed in a casing 208, such as being movable along a central axis 216 of the housing 208. Each impulse unit 202, 204, 206 is packaged in a relatively solid pyrotechnic housing 202*a*, 204*a*, 206*a*, within which is packaged the primary propellant charges 202*b*, 204*b*, 206*b*.

Each unit is capped with a relatively brittle cap 202*c*, 204*c* (not visible on impulse unit 206) which can further have a means to facilitate breaking, such as having scored frontal face 202*d*, 204*d* (not visible on impulse unit 206), such that back pressure generated by ignition of the primary propellant charges 202*b*, 204*b*, 206*b* would shatter the cap 202*c*, 204*c* into small enough pieces that could be discharged through a thruster nozzle 210 at the front end of the housing 208. In operation, the front (in the direction of the nozzle 210) impulse unit 202 is first initiated. The initiation is achieved electrically by the initiation of the aforementioned low-energy and very fast electrical initiation (shown schematically in FIG. 2*a* as 212 for clarity), with unfolding wires provided through a side channel (not shown) to each impulse unit 202, 204, 206. Following initiation of each impulse unit, a next impulse unit (in the direction opposite to the nozzle 210) is pushed forward towards the nozzle 210 by an aft compressively preloaded spring 214, for the purpose of ensuring minimal volume space that gasses generated by each impulse unit have to expand, thereby increasing pressure and temperature at which the gasses begin to exit the nozzle 210 and the generated impulse. FIG. 2*b* illustrates the device 200 in which the forward impulse unit 202 has been initiated and a subsequent impulse unit 204, in a stack of impulse units 202, 204, 206 is pushed to the forward position by the spring 214. The housing 202*a*, 204*a*, 206*a*, with the exception of the caps 202*c*, 204*c*, can be a portion of the propellant charges or consumed by the same so as to not interfere with the movement of the next impulse unit 202, 204, 206 to the end position near the nozzle 210.

The impulse unit caps 202*c*, 204*c* have dual purpose, firstly to prevent sympathetic ignition of the next (uninitiated) impulse unit in the stack, and secondly to allow pressure and temperature to rise inside the ignited impulse unit before generated gasses are released into the nozzle 210 volume, thereby increasing the rate of propellant burn and decreasing the generated impulse duration and make its timing more predictable.

Novel Motor-Driven Pulsed Actuation Devices for High-Speed Guided Munitions

Figure 3B:
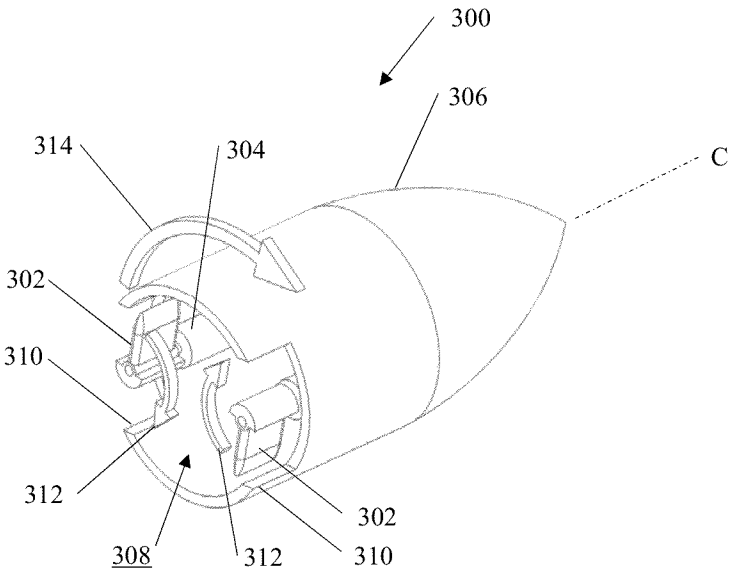
FIGS. 3*a* and 3*b* illustrate a high spin rate guided munition having a rotary motor driven actuation device, FIG. 3*a* illustrating a deployed control surface and FIG. 3*b* illustrating the control surface being withdrawn.
Figure 3A:
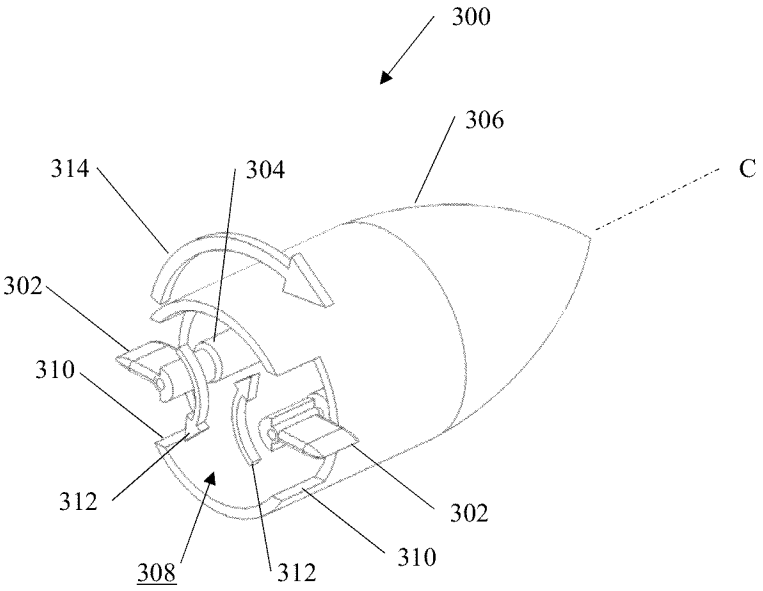

Referring now to FIGS. 3*a* and 3*b*, there is illustrated a novel rotary motor driven actuation device for developing a short duration pulsed actuation that can be used to drive quasi-continuous drag or lift type control surface control for fin or canard actuation for high-speed rounds. The pulsed actuation devices operate by electrical motors that rotate at constant speeds, which are synchronized with the roll angle rotation, thereby are capable of operating with low power for high-spin rate guided munitions.

An operation of these pulsed actuation devices is based on deploying the drag or lift producing element during a short projectile range of roll angle, which centered about the desired round roll angle, and withdrawing it during the remaining range of roll angle rotation.

The device and operation of such pulsed actuation devices is described with reference to FIGS. 3*a* and 3*b*. The munition (alternatively referred to herein as a projectile or round) 300 illustrated in FIGS. 3*a* and 3*b* employs a pair of fins 302 which rotatably disposed relative to body (or casing) 306 of the projectile 300 and are rotated by electrical motors 304 or the like. Hereinafter, the deploying drag or lift generating elements are indicated simply as fins, even though they may also be positioned close to the tip of the round to act as canards. As can be seen in FIGS. 3*a* and 3*b*, the fins 302 are positioned such that they can fully rotate, one full revolution of the fin 302 being comprised of a "deployed" portion, FIG. 3*a*, when the fin 302 is exposed outside a body 306 of the projectile 300 and a "dwell" portion, FIG. 3*b*, when the fin 302 is rotating within an interior 308 of the body 306 of the projectile 300. A window or slot 310 may be provided in the body 306 of the projectile 300 to allow for the rotation of the fins 302. The deployed portion of fin rotation can be characterized by the angle through which the fin 302 sweeps while outside the projectile body 306 (based on radial position of the fin's rotational axis relative to the projectile centerline C) and the speed at which the fin 302 is rotated (arrows 312). The fin sweep angle will determine the ratio of deployment to dwell in constant-fin-speed operation. The ratio and speed may be selected such that each fin 302 deploys twice per spin revolution (arrow 314) of the projectile 300, the second deployment being 180° opposite the first. From an observer on the ground, this would appear as the two fins 302 rotating in and out of the projectile body 306 with a constant average orientation (plane) with respect to the ground while the projectile 300 is spinning.

For example, the fins 302 may be deployed such that their maximum protrusion from the body 306 (center of their deployed motion) always occurs in a plane parallel to the horizon even though the projectile is spinning. The rotation of the fin motor 304 must obviously be synchronized with the roll angle (spin) of the projectile 300 so that the fin deployment occurs only in a plane parallel to the horizon. By producing a positive or negative roll angle deployment offset (such as during the fin dwell) in the fin motor rotation angle, the fins 302 are deployed slightly above or below the plane of horizon, thereby providing a simple signal for steering (guiding) the spinning round 300 in the desired direction.

Figure 4B:
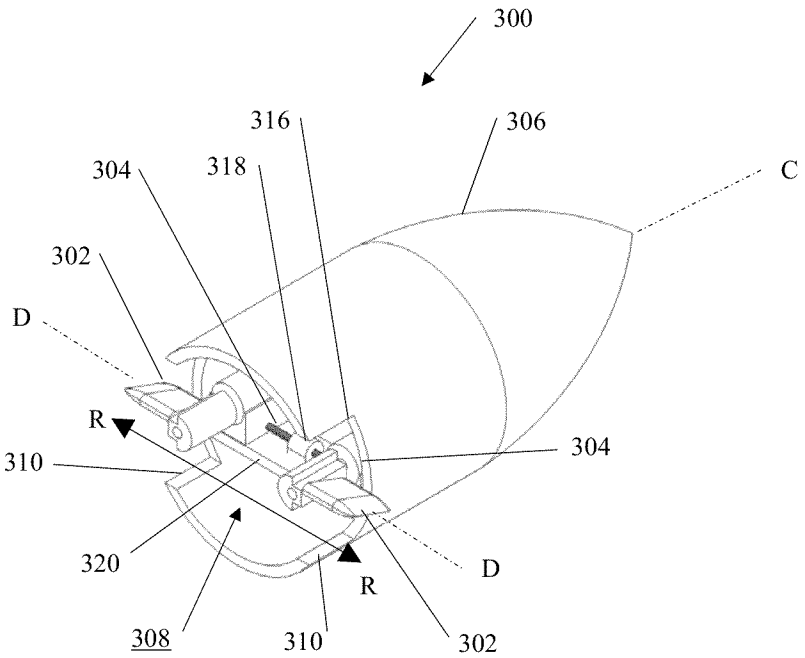
Figure 4A:
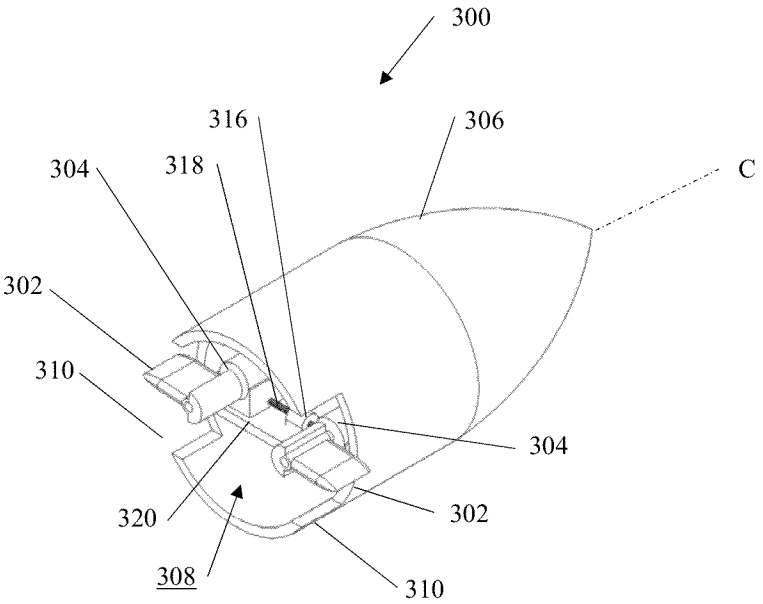

In the projectile 300, the amplitude of the fin deployment may be readily varied using a number of different mechanisms, an example of which is shown in FIGS. 4*a* and 4*b*. In this device, the motor-fin units 302/304 are shown to be repositioned using an adjustment motor 316 and lead screw 318. The fin motors 304 are fixed to a saddle 320 which can translate in the radial direction R either towards or away from the centerline C of the projectile 300. FIG. 4*b* illustrates the control surfaces (fins 302) being radially deployed relative to the centerline C of the projectile 300 as compared to the radial position of the control surfaces (fins 302) in FIG. 4*a*. This additional feature will allow for control of the maximum protrusion of the fin 302 from the projectile body 306 as well as the deployed-dwell ratio of the fin rotation cycle. The saddle 320, lead screw 318 and motor 316 arrangement are just one way in which the fin-motor 302/304 units may be repositioned, those skilled in the art will appreciate that multiple variants of cams and/or linkage arrangements may be used as well.

As discussed above, a speed and deployment-to-dwell ratio is selected which results in steady-state deployment of the fins 302 centered on a fixed plane relative to the ground. If the roll angle synchronization angle of fin rotation is varied during the dwell cycle, the plane of deployment will be rotated about the spin axis of the projectile 300. Small changes in the synchronization angle provide for rotation of the fin deployment plane from horizontal.

Figure 5:
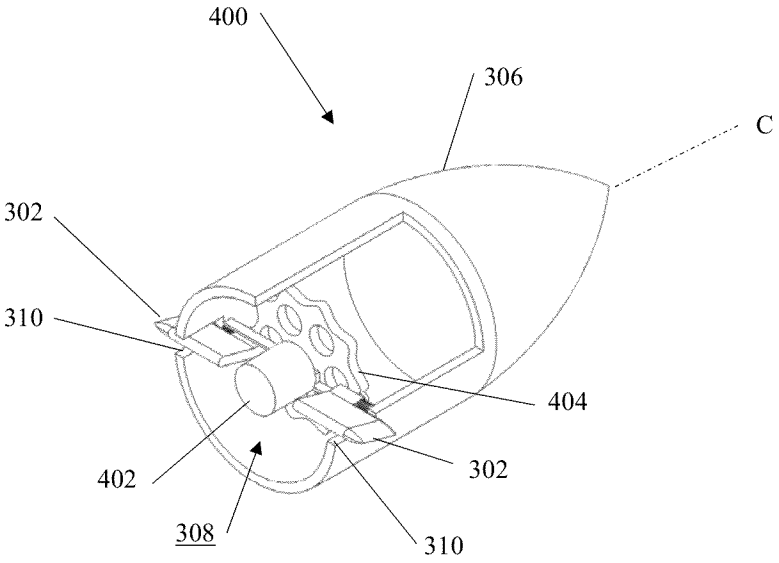
FIG. 5 illustrates another embodiments of a high spin rate munition having a rotary motor driven actuation device.

FIG. 5 illustrates another rotary (e.g., electrical) motor driven actuation device, generally referred to by reference numeral 400, which is particularly suitable for munitions that spin at very high spin rates. In FIG. 5, like features from FIGS. 3*a*, 3*b*, 4*a* and 4*b* designate like features and a portion of the body (casing) 306 of the projectile 400 is removed to view the interior 308 of the projectile 400. In the projectile, 400, the rotation of the actuator motor 402 can also be synchronized with the spin rotation (roll angle) of the projectile 400. In the projectile 400 shown in FIG. 5, a single motor 402 is used to drive a multi-lobed cam wheel 404. The cam wheel 404 drives a pair of linear-guided fins 302 in and out of a side window/slot 310 of the projectile body 306 through cam followers 406 mounted on the fins. The timing of the deployment of the fins 302 (which determines the fin deployment plane relative to the ground) is controlled by the speed of the cam wheel 404, which can be synchronized with the spin rate and roll angle of the projectile 400.

The configuration shown in FIG. 5 may be implemented with additional pairs of fins 302 with one motor for each pair of opposing fins 302, which is most suitable for medium caliber munitions since they require relatively small volume requirement. The configuration of FIG. 5 may also be implemented with one motor for each fin, which is more suitable for larger caliber munitions. Intermediate linkage mechanisms can also be provided that also allow for control of the maximum protrusion of the fin from the projectile by the addition of a second motor.

Several additional fin control action devices may also be readily implemented. For example, the fin protrusion level may also be coupled with the fin pitch angle, i.e., more protrusion would provide more lift or drag. One other option is to decrease the speed of the actuator motor thereby deploying the fin every two or more full projectile spins. Yet another option is to add a second motor for varying the fin pitch by rotating the fins about axis D (as shown in FIG. 4*b*).

The Roll Angle Measurement Sensor

FIGS. 6*a*, 6*b*, 7*a* and 7*b* illustrate polarized RF angular orientation sensors, a full description of which is contained in U.S. Pat. Nos. 8,259,292; 8,258,999; 8,164,745; 8,093,539; 8,076,621 and 7,425,918, the entire contents of each of which are incorporated herein by reference. Such polarized RF angular orientation sensors can be constructed with geometrical cavities that operate with scanning polarized RF reference sources in a configuration shown in FIGS. 6*a* and 6*b*.

Figure 6B:
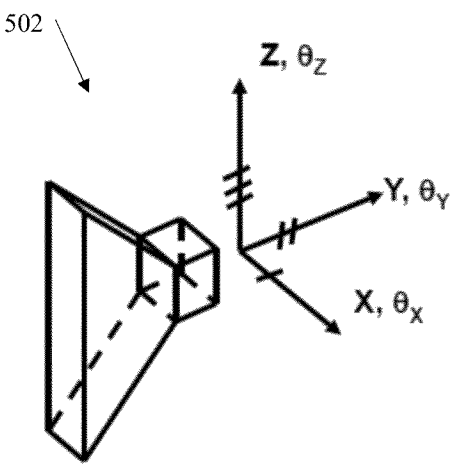
FIG. 6*a* illustrates a linearly polarized RF reference source and 6*b* illustrates a corresponding cavity sensor for use onboard munitions.
Figure 6A:
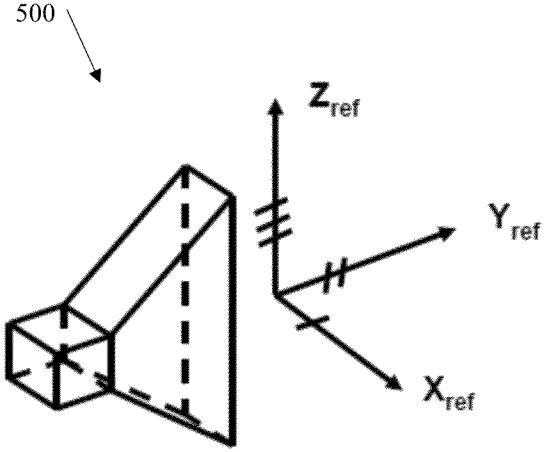
Figure 7B:
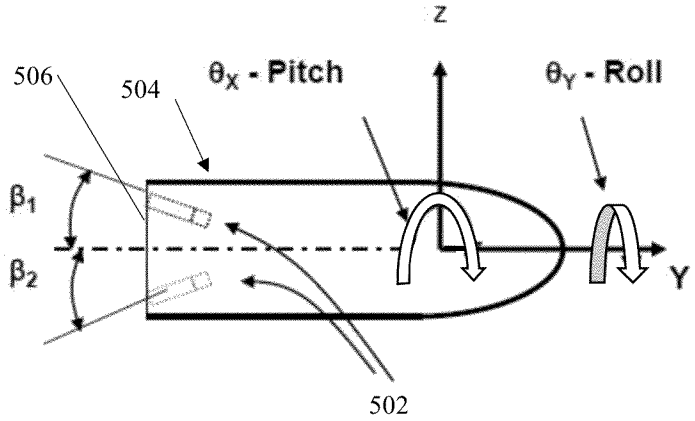
FIG. 7*a* illustrates an end view of a projectile having the sensors of FIG. 6*b* positioned on a base of the projectile and 7*b* illustrates a side view of the projectile of FIG. 7*a*.
Figure 7A:
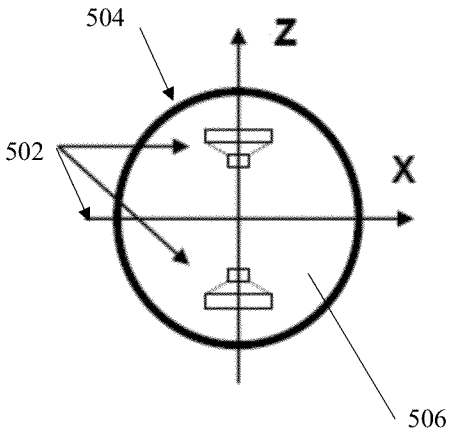

Referring to FIG. 6*a*, in the sensory system, a polarized RF reference source 500 transmits electromagnetic waves with polarization planes parallel to the $Y_{ref}Z_{ref}$ plane of the reference coordinate system $X_{ref}Y_{ref}Z_{ref}$ shown in FIG. 6*a*. When the reference source 500 is used to scan a prescribed pattern, the measured signal at a sensor cavity 502 illustrated in FIG. 6*b* and positioned on a projectile, for example, on the base of the projectile as shown in FIGS. 7*a* and 7*b*, and the pattern of the signal provides the actual roll angle orientation of the sensor (and hence the projectile) relative to the reference source 500 onboard the projectile. Through modeling and computer simulation, anechoic chamber and range tests, such a polarized RF sensory system allows the roll angle of high-spin rounds to be measured with high precision directly onboard the projectile. In general, however, due to symmetry in the propagated electromagnetic wave, "up and down" of the rolling projectile orientation cannot be differentiated. This issue can be readily resolved for spinning rounds as described below.

In a first device on the ground, the polarized RF reference source 500 transmits electromagnetic waves with polarization planes parallel to the $Y_{ref}Z_{ref}$ (i.e., the horizontal) plane of the Cartesian reference coordinate system $X_{ref}Y_{ref}Z_{ref}$ shown in FIG. 6*a*. Two identical polarized RF cavity sensors 502 are embedded into a base 506 of a projectile 504 at angles 131 and $\beta_2$ as shown in FIGS. 7*a* and 7*b*. Each one of the sensors 502 can be used to measure the roll angle with an appropriately patterned scanning reference source 500, but without being able to differentiate "up and down" as previously indicated. However, since the reference source 500 is on the ground, by making the angles $\beta_1$ and $\beta_2$ significantly different, at each of their horizontal roll angle positioning, the sensor 502 that is closer to being lined up with the direction of the reference source 500 will receive larger amplitude signals from the reference source 500. By comparing the relative amplitudes of the received signals, up and down orientation of the projectile in roll is thereby differentiated. In addition, since the actual angles $\beta_1$ and $\beta_2$ are known, the difference between the (average) magnitudes of the two measured signals would provide an indication of the projectile pitch angle. The pitch angle of the fins relative to the centerline of the projectile can then be varied as discussed above with regard to FIG. 4*b* to adjust the pitch of the projectile.

Expected Pulsed Actuation Impulse Magnitude and Dynamic Response

The novel (pulsed) actuation control surface actuation devices described above will have very high dynamic response characteristics. The first class of impulse actuation devices described with regard to FIGS. 1, 2*a* and 2*b* are based on detonation of charges and reliable electrical initiators for detonation within 20-50 microseconds. In addition, one-shot impulse actuation providing around 10 N-sec with sub-millisecond durations can also be achieved using higher energy explosive charges to provide significantly larger impulse and shorter duration, thereby providing several of these impulses per second during each revolution of the munitions, it is apparent that such multi-stage pulsed actuation devices can readily be sized to provide impulses in the range of 10 N-sec to 140 N-sec. Similar and even significantly higher impulse levels can be achieved with the second class of actuation devices described with regard to FIGS. 3*a*, 3*b*, 4*a*, 4*b* and 5 by using them to actuate canards and by varying the amplitude of canard deployment and realizing that they are deployed twice during each roll spinning of the munitions (as determined, for example, by the system of FIGS. 6*a*, 6*b*, 7*a* and 7*b*) almost continuously during the flight.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A control actuation device for a munition, the actuation device comprising:

a body having a cavity with an open end exposed to an exterior;

a slug/charge stack disposed in the cavity, the slug/charge stack comprising:

a first slug retained in the cavity and a corresponding first charge positioned in the cavity such that initiation of the first charge burns propellant contained in the first charge to produce pressure to eject the first slug from the open end to the exterior; and one or more second slugs retained in the cavity and one or more corresponding second charges positioned in the cavity such that initiation of the one or more second charges burns propellant contained in the one or more second charges to produce pressure to eject the one or more second slugs from the open end to the exterior, the one or more second slugs being one or more positioned or sized so as to not interfere with portions of the cavity when being ejected from the open end; and an initiator corresponding to each of the first charge and one or more second charges for selectively initiating the first charge and one or more second charges.

2. The actuation device of claim 1, wherein the cavity includes threads at least in portions corresponding to the first slug and the one or more second slugs and the first slug and the one or more second slugs each include a mating thread for retaining the first slug and the one or more second slugs in the cavity.

3. The actuation device of claim 1, wherein the cavity includes a first step at the open end having a first diameter for retaining the first slug and one or more second steps having a second diameter smaller than the first diameter for retaining the one or more second slugs.

4. A control actuation device for a munition, the actuation device comprising:

a body having a cavity with an open end exposed to an exterior;

two or more impulse units disposed in the cavity so as to be movable towards the open end, each of the two or more impulse units comprising:

an outer casing having an end face on an end of the two or more impulse units closest to the open end; and a propellant charge contained within the outer casing;

a spring for biasing the two or more impulse units towards the open end; and an initiator corresponding to each of the two or more impulse units for selectively initiating the propellant charge in each of the two or more impulse units.

5. The actuation device of claim 4, wherein the body further comprises an accelerating nozzle positioned at the open end.

6. The actuation device of claim 4, wherein the spring biases the two or more impulse units towards the open end such that a front-most impulse unit of the two or more impulse units in a direction towards the open end is positioned at the open end and prior to the nozzle.

7. The actuation device of claim 4, wherein the front face of the outer casing includes means for facilitating breakage of the front face when acted upon by a predetermined pressure from initiation of a corresponding propellant charge.

8. The actuation device of claim 7, wherein the means for facilitating breakage of the front face includes one or more score marks on the front face.

9. A method for deploying a control surface from an exterior surface of a spinning projectile during flight, the method comprising:

moving the control surface in an interior of the projectile such that a portion of the movement retracts the control surface into the interior and a portion of the movement extends the control surface from the exterior surface of the projectile;

determining a roll angle of the projectile; and synchronizing the movement of the control surface with the roll angle of the projectile.

10. The method of claim 9, wherein the synchronizing comprises moving the control surface to extend from the exterior surface of the projectile based on an orientation of the control surface relative to the ground.

11. The method of claim 10, wherein the control surface is moved such that it is maximally extended from the exterior surface of the projectile when the projectile roll angle is determined to orient the control surface parallel to the ground.

12. The method of claim 10, wherein the control surface is moved such that it is maximally extended from the exterior surface of the projectile when the projectile roll angle is determined to orient the control surface prior to or after being parallel to the ground to steer the projectile.

13. The method of claim 9, wherein the determining is performed onboard the projectile.

14. The method of claim 9, wherein the control surface is movable in rotation.

15. The method of claim 9, wherein the control surface is movable in translation.

16. The method of claim 9, wherein the control surface is movable in rotation and translation.

17. The method of claim 9, wherein the determining of the spin of the projectile comprises:

transmitting scanning electromagnetic waves having a predetermined pattern in a reference coordinate system towards the projectile;

measuring the electromagnetic waves at two or more cavity sensors positioned on the projectile with a predetermined geometry relative to each other;

measuring the roll angle of the projectile based on an output from the two or more cavity sensors.

18. The method of claim 9, further comprising:

determining a pitch of the projectile relative to a longitudinal center line of the projectile; and pitching the control surface in a direction offset from the longitudinal center line to adjust the pitch of the projectile at least during the portion of the movement that extends the control surface from the exterior surface of the projectile.

19. The method of claim 18, wherein the pitching of the control surface comprises rotating the control surface about an axis perpendicular to the longitudinal center line.

20. The method of claim 19, wherein the determining of the pitch of the projectile comprises:

transmitting scanning electromagnetic waves having a predetermined pattern in a reference coordinate system towards the projectile;

measuring the electromagnetic waves at two or more cavity sensors positioned on the projectile with a predetermined geometry relative to each other;

measuring the pitch of the projectile based on an output from the two or more cavity sensors.

* * * * *